United States Patent [19]

Mäkilä et al.

[11] 4,036,440

[45] July 19, 1977

[54] METHOD AND APPARATUS FOR THE TREATMENT OF WASTE WOOD, SUCH AS STUMPS AND SNAG, TO MAKE IT SUITABLE FOR THE PRODUCTION OF PAPER PULP

[75] Inventors: Eino Mäkilä, Pulp; Unto Virtanen, Joutseno; Kyösti Savinainen, Pulp, all of Finland

[73] Assignee: Joutseno-Pulp Osakeyhtio, Pulp, Finland

[21] Appl. No.: 645,337

[22] Filed: Dec. 30, 1975

[30] Foreign Application Priority Data

Jan. 17, 1975 Finland ..... 750112

[51] Int. Cl.[2] ..... B02C 23/10

[52] U.S. Cl. ..... 241/20; 144/208 D; 144/311; 209/3; 209/173; 241/24; 241/28; 241/79

[58] Field of Search ..... 162/55; 241/24, 28, 241/29, 76, 77, 78, DIG. 38, 20, 79; 209/3, 17, 157, 172, 173; 144/208 D, 311

[56] References Cited

U.S. PATENT DOCUMENTS

| | | | |
|---|---|---|---|
| 1,770,430 | 7/1930 | Respess | 162/55 |
| 2,488,041 | 11/1949 | Swift | 144/208 D |
| 3,064,806 | 11/1962 | Hukki | 209/17 |
| 3,279,597 | 10/1966 | Reinhall | 209/17 |
| 3,337,139 | 8/1967 | Lloyd et al. | 209/17 |
| 3,367,495 | 2/1968 | Lea et al. | 162/55 |
| 3,708,063 | 1/1973 | Morimasa | 209/3 |
| 3,765,532 | 10/1973 | Morris et al. | 209/17 |
| 3,826,433 | 7/1974 | Erickson | 241/24 |
| 3,834,561 | 9/1974 | Crow | 241/24 |
| 3,878,994 | 4/1975 | Tee | 241/24 |

*Primary Examiner*—S. Leon Bashore
*Assistant Examiner*—Peter F. Kratz
*Attorney, Agent, or Firm*—Roylance, Abrams, Berdo & Kaul

[57] ABSTRACT

Waste wood, such as stumps and snag, is treated to make it suitable for the production of paper pulp, whereby the raw waste wood is initially crushed so that part of the bark, sand and stones attached to the wood is detached at this stage already, the obtained crushed material is fed into a washer tank for further washing away bark, sand, stone and peat material from the wood, high-pressure water nozzles being provided at an inlet end of said washer to impinge strong water jets on the crushed wood material, and flow creating means being provided at the lower part of the washer tank to produce a water flow directed slantedly upwards towards an outlet end of the washer tank in order to entrain heavy wood fragments, which may tend to sink into the material leaving the washer tank at said outlet end thereof, said material being further after-crushed and sieved to separate an accept fraction thereof for feeding to a pulp production process. The wood material fed to the process may be mixed with conventional wood chips.

9 Claims, 3 Drawing Figures

METHOD AND APPARATUS FOR THE TREATMENT OF WASTE WOOD, SUCH AS STUMPS AND SNAG, TO MAKE IT SUITABLE FOR THE PRODUCTION OF PAPER PULP

BACKGROUND OF THE INVENTION

1. Field of the Invention

This invention relates to an improved method and an improved apparatus for the continuous treatment of waste wood, such as stumps and snag, to make it suitable for the production of paper pulp, whereby the incoming wood material is initially crushed in order to detach part of the impurities therein and the crushed material is substantially washed with water in a washer tank.

2. Description of the Prior Art

As it is becoming more difficult to obtain wood for cellulose production and as wood prices are on the increase, more attention is being paid to the possibilities of exploiting waste wood. Thus, stumps and snag will play a substantial role as raw material.

Although the strength properties of cellulose manufactured from conventional wood chips are somewhat better than those of cellulose pulp produced from waste wood, small and even considerable quantities of stump material mixed with other wood material will not substantially affect the quality of the produced paper. For example, in sack paper a small portion of stump material is even advantageous as it improves the formation.

The limitatiOns of using marginal wood are not so much due to its fiber properties as they are to the difficulties and expenses caused by the impurities present in it. These impurities mainly consist of stones, sand, and earth; bark can also be counted among them. The separation of the impurities is often complicated by the fact that they are partly imbedded in the wood. Furthermore, it is obviously more difficult to remove bark from stumps than from ordinary paper timber, owing to the irregular shapes of stumps.

Mainly because of the above problems, the conclusion made in research so far has generally been that the use of waste wood for pulp production is in principle possible but in practice too uneconomical to implement.

SUMMARY OF THE INVENTION

The present invention provides an improved method of the character once described, wherein the improvement comprises subjecting the crushed material fed into the washer to strong water jets to make the washing more effective and to promote the detaching of the bark, creating in the washer tank a flow with a controllable strength, directed slantedly upwards towards an outlet end of the tank, in order to entrain the heavy crushed wood fragments, which tend to sink with the sand and stones, among the accept wood material discharged from the washer, the said flow being, however, maintained so low that practically no heavy impurities can pass along with the wood material.

According to the invention there is also suggested an apparatus to carry out the method, said apparatus comprising a crusher for crushing the incoming wood material, a washer tank for washing the crushed raw material in order to remove sand, earth and stones therefrom, high-pressure water nozzles at an inlet end of said washer, impinging strong water jets on the crushed wood material to promote the detaching of stones, earth and bark present in the incoming wood material, flow creating members in the lower part of the washer tank creating a water flow directed slantedly upwards towards an outlet end of the washer tank, said flow creating means being so adjusted that the flow produced thereby cannot lift sand and stone particles along with the washed and crushed wood material.

Seen against the background described above, the object of the present invention is to provide a method and apparatus for the treatment of waste wood, especially stumps, to make it suitable for the production of pulp, which method and apparatus are more economical and better suited for a continuous process than those introduced previously. The invention especially comprises the methods by which the impurities detrimental to pulp and machinery can be removed from waste wood to a sufficient degree and by which as great a part as possible of the usable wood material can be recovered.

DESCRIPTION OF THE PREFERRED EMBODIMENTS

Figure 1:
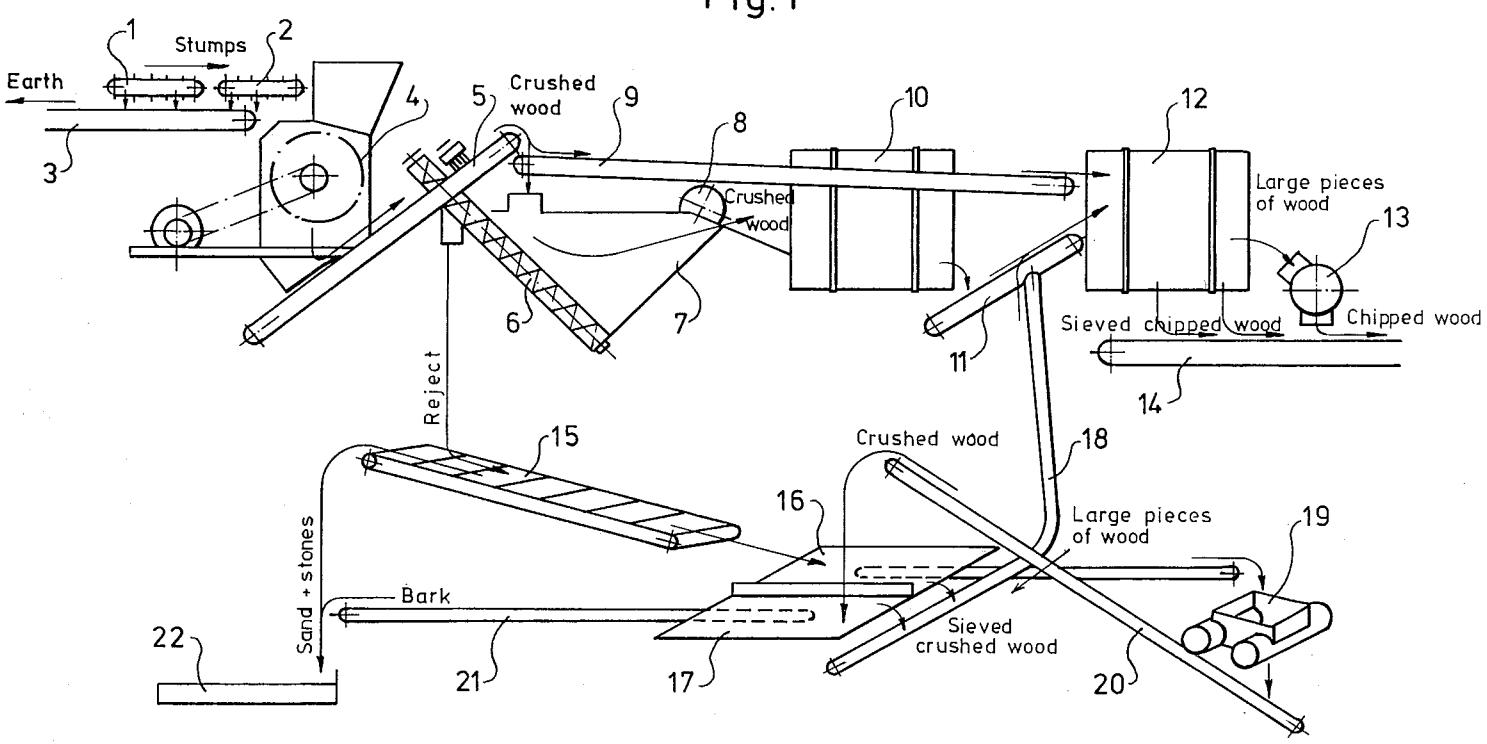
FIG. 1 depicts the principle of an apparatus arrangement according to the invention.

Referring to FIG. 1, the material to be crushed is conveyed by sieve conveyors 1, 2 into a crusher 4. Impurities, mainly stones and earth, become detached from the stumps already on the conveyors 1, 2, and these impurities are removed by a conveyor 3. The stumps are fragmented in a crusher, which has proven less prone to damage than e.g. a chopper, the blades of which are easily damaged by the stones accompanying the stumps.

During the fragmenting by the crusher 4, a considerable part of the earth, bark, and stones is detached, or at least made easier to detach later on owing to the vibration. The crushed material is conveyed from the crusher by conveyors 5 further to a washer 7, which is a substantially funnel-shaped water tank. Number 9 refers to a bypass conveyor which can be used if the wood material does not require a wash.

From the washer, described below in more detail, the crushed material passes along with water into a rotating sieve drum 10, wherein the remaining impurities are rinsed off and wherefrom the crushed material is conveyed by a conveyor 11 to a second sieve drum 12. In the latter drum, large pieces of wood are sieved off and conveyed further to a so-called stick chopper 13 to be fragmented. The sieved chipped or crushed wood thus produced is conveyed by conveyor 14 to the pulp productin process.

In the washer 7, the earth, sand, stones, and bark materials are separated by a method described below and they constitute a reject, which is removed continuously from the washer by means of a slanted screw 6. Since the reject still contains heavy pieces of wood, sunk in the water together with sand and stones, the reject, according to the invention, is still treated separately in order to recover the heavy wood material. It is true that the said wood material constitutes only a few percent of the total wood yield, but on the other hand, said wood material with a heavy specific weight contains a great quantity of pitch, from which tall oil and turpentine are obtained as valuable byproducts of cellulose production.

Several chemical processes could be considered for the recovery of the said byproducts from the reject, but since the quantities concerned are usually relatively small, it is practical to perform the separation in such a manner that the wood material can be separated from the impurities and fed to the pulping process, in connnection with which the byproducts are recovered from the entire chip quantity.

Before discussing the treatment of the reject it may be advisable to describe the operation of the washer 7 in more detail.

Figure 2:
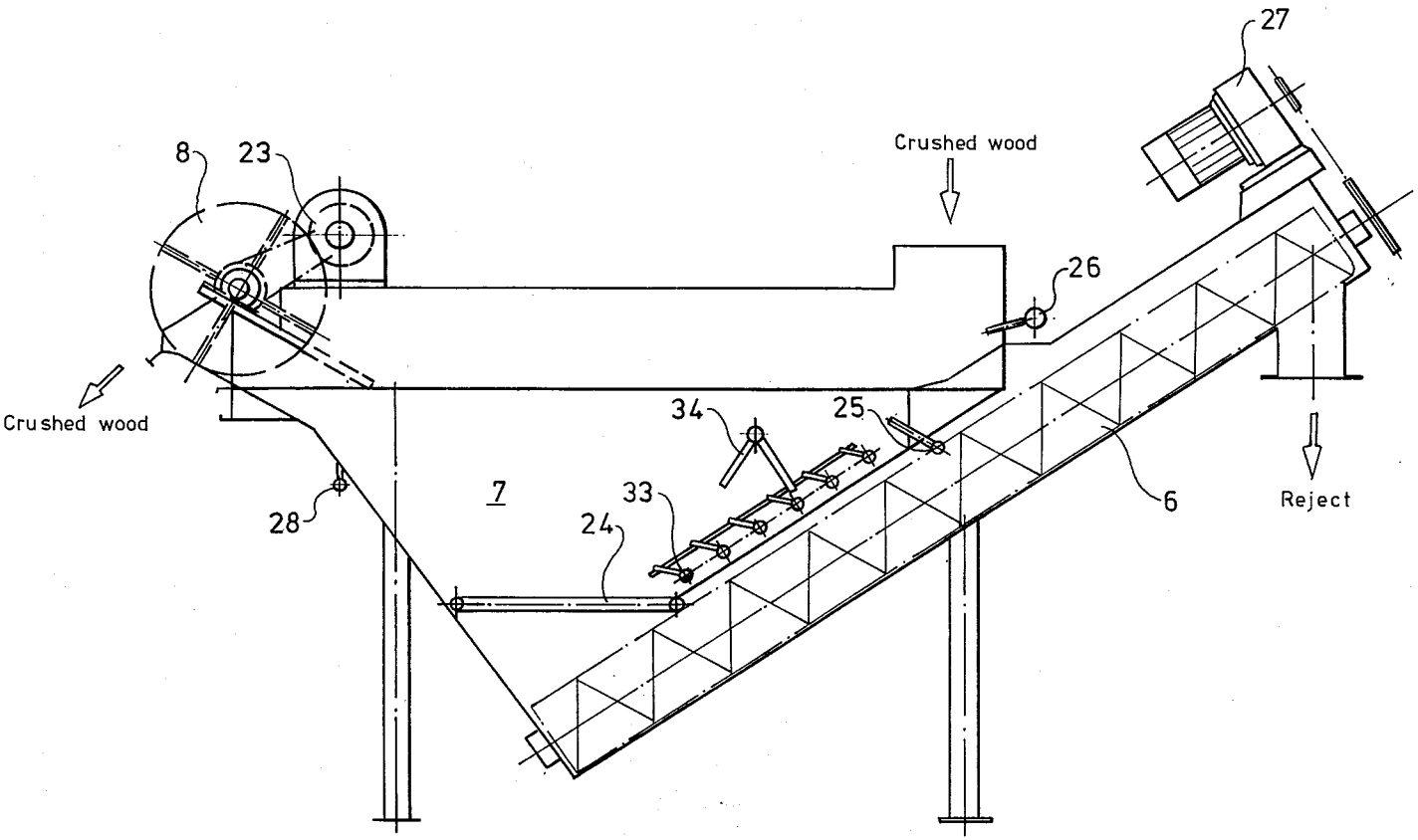
FIG. 2 depicts a schematic side view of a washer, which is an essential part of the arrangement.

FIG. 2 depicts one embodiment of the washer. The crushed material is fed into the washer at the point indicated by an arrow in the figure, and the incoming crushed material is subjected at this point to very strong water jets from high-pressure water nozzles 26 and 25. Besides naturally promoting the rinsing away of sand and earth, the water jets are also capable of detaching bark to a considerable degree; the crusher has already started the loosening of the bark.

The crushed material mainly passes directly towards the outlet end of the washer, wherefrom it is removed in the direction indicated by an arrow by means of a bladed wheel 8 positioned at the outlet end of the washer and rotated by a motor 23. The blades of the wheel extend somewhat below the water surface.

The earth, sand, and stones, being heavier than water, sink to the bottom of the tank 7, wherefrom reject is removed by means of a slanted screw 6, driven by a motor 27 and sunk into a groove at the bottom of the tank, the groove having a mainly U-shaped cross section. In practice it has been noted as a positive factor, at least in the treatment of swamp stumps, that most of the bark also sinks to the washer bottom and is therefore removed. On the other hand, there are wood fragments with so high a specific weight that they tend to sink. In order to solve this problem, several steps are taken according to the invention for the further treatment of the reject.

According to the embodiment depicted in FIG. 2, a number of flow nozzles 33 have been arranged in the water. They are used to spray pressurized water and cause a flow directed slantedly upwards towards the outlet of the washer. The direction of this flow can be suitably adjusted by means of levers 34 so that part of the otherwise sinking wood material can be caused to rise on the bladed wheel 8. Number 24 refers to a ring made from pipe; through the numerous perforations in the ring, air is blown in order to prevent the blocking of the bottom throat of the washer. Furthermore, the air-blowing ring 24 also promotes the upward flow. An upwards-directed pressurized-water nozzle 28 close to the outlet of the washer has also been found advantageous in terms of the washing results, although it is not necessary for the application of the invention.

Since water continuously flows off along with the washed chips, a continuous water flow through the water is obtained. The water can be recycled through the settling tank or, if desired, fresh water can also be fed continuously.

Figure 3:
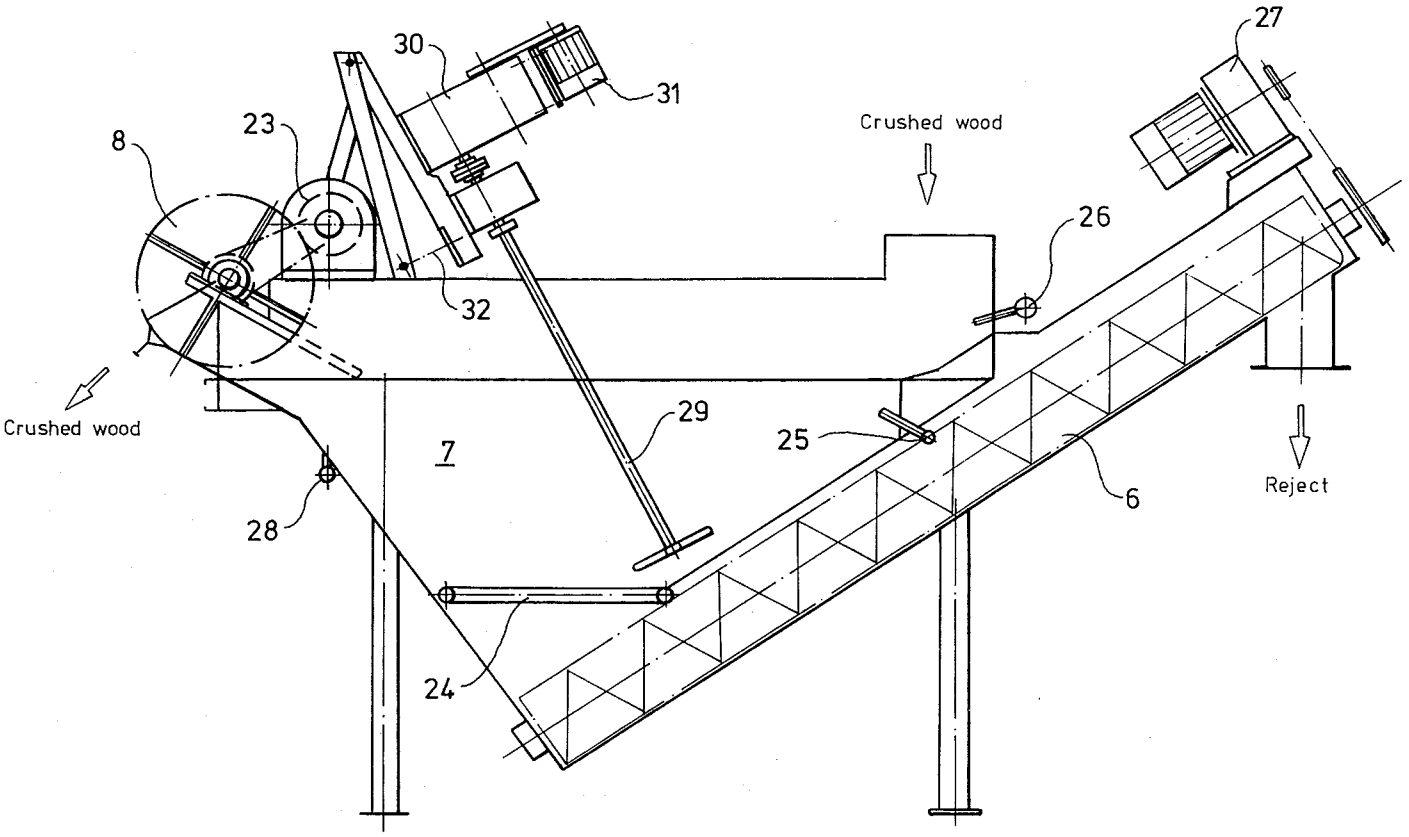
FIG. 3 depicts a view, similar to FIG. 2, of another embodiment of the washer.

FIG. 3 depicts another embodiment of the washer, wherein the flow directed slantedly upwards has been produced by means of a propeller 29, both the slanting angle 32 and the rotative velocity of the propeller being controllable by means of a variator 30. The propeller is driven by an electric motor 31.

Although, according to the invention, an upward flow is produced in the washer tank, one essential feature of the invention is the fact that no attempt is made to cause unexclusively all the wood material in the washer to rise to the water surface, but the heaviest parts are allowed to pass into the reject. This ensures that the crushed wood emerging from the washer is sufficiently pure. All wood fragments could be caused to rise to the surface by means of a flow strong enough, but this would also rise earth and sand along with the crushed wood. It is necessary that the direction and the strength of the flow can be controlled so that the optimal operation conditions can always be selected for the washer, depending on the raw material fed into it.

According to the invention the reject is subjected to a special separation treatment in the manner depicted in the lower part of FIG. 1, for example. The sand and the stones are first removed from the reject emerging from the washer, by means of a so-called sand separator 15, whose separation capacity in the embodiment concerned has been found very good. The slanted sand separator has transversal dogs which continuously lift sand and stones upwards. By a water rinse the wood and bark are respectively caused to be removed from the lower part of the sand separator. Large pieces of wood are sieved off by means of a sieve 16 and taken by conveyors 18 and 11 further to a sieve drum 12 and to the process. Smaller pieces of wood, some bark among them, are fed to a roller crusher 19, wherein the bark is ground into fine powder. The finely divided material is lifted by conveyor 20 onto a sieve 17, wherefrom the crushed particles of wood, which are mainly oblong, flow onto conveyor 18 and the pulverous bark passes onto conveyor 21 and is removed from the system at a collecting point 22. In the example illustrated, the coarse sieve 16 and the fine sieve 17 have, for the sake of simplifying the construction, been built together and separated from each other by a partition.

What is claimed is:

1. A method for the continuous treatment of raw waste wood including stumps and snag to remove sand, stone, earth, other impurities and bark attached thereto and embedded therein and to thereby render said waste wood suitable for the production of pulp, the method comprising delivering said raw waste wood to a crushing zone;

crushing said raw waste wood to fragment it and to partially loosen the attached and embedded impurities and bark therefrom;

passing the crushed wood fragments, detached impurities and detached bark to a washing zone including a washing tank containing water;

subjecting the material fed into the washing zone to jets of water under high pressure as the material enters the washing tank to further promote the removel of bark and impurities from the crushed wood fragments;

passing said materials fed into the washing zone into the water in said water tank where an accept portion, comprising crushed wood fragments and bark, tends to float to a discharge outlet at the top surface of the water and a reject portion, comprising sand, stone, earth, bark and heavier crushed wood fragments, tends to sink to a discharge outlet at the bottom of said water tank;

subjecting the sinking material in the washing tank to submerged flow jets;

controlling the strength and direction of said submerged flow jets to entrain the heavier crushed wood fragments with the accept crushed wood fragments while permitting the sand and stone impurities and the heaviest crushed wood fragments to sink to the bottom of the washing tank;

discharging said accept portion, including the heavier crushed wood fragments entrained therewith, from the top surface of the water tank and delivering said accept portion to a chipper for further treatment;

passing said reject portion to a separation zone where the sand and stones therein are separated from the heaviest crushed wood fragments and bark therein;

feeding said separated crushed heaviest wood fragments of the reject portion to a coarse sieve which retains the larger heaviest crushed wood fragments of the reject portion; and passing the retained larger heaviest crushed wood fragments of the reject portion to the chipper where they are reduced to a size suitable for pulp porduction.

2. A method according to claim 1 which includes transporting the discharged accept portion and the retained larger heaviest crushed wood fragments of the reject portion to a sieve drum wherein pieces of acceptable size are separated out for pulping, and then passing the larger pieces thereof to the chipper.

3. A method according to claim 1 which includes, after the step of feeding the separated fragments of the reject portion to a coarse sieve, the steps of passing those pieces which pass through said coarse sieve, which consist substantially of small wood and bark fragments, to a roller crusher to pulverize the bark;

delivering the material from the roller crusher to a finer sieve through which the pulverized bark material passes to be discarded from the system and on which the primarily oblong wood particles are retained; and returning the retained wood particles to a drum sieve for further processing.

4. An apparatus for continuous treatment of waste wood including stumps and snag to remove sand, stone, earth and other impurities and bark attached thereto and embedded therein to thereby render said waste wood suitable for production of pulp, the apparatus comprising crusher means for fragmenting said raw waste wood and partially loosening the attached and embedded impurities and bark therefrom;

a washer tank for washing the sand, earth and stone impurities and bark from said crushed wood fragments and for separating said materials into accept and reject portions, said washer tank having a body of water therein sand having an inlet region for receiving the output from said crusher means, a first outlet region near the surface of said body of water for discharging an accept portion of said crusher output, comprising crushed wood fragements and bark which tend to float near the surface of said body of water, and a second outlet region at the bottom of the water tank for discharging a reject portion of said crusher output, comprising sand, stone, earth, bark and heavier crushed wood fragments which tend to sink towards said second outlet region;

means adjacent said first outlet region for removing said accept portion from said tank;

nozzle means near the inlet region of said washer tank for directing jets of water under high pressure against the crushed wood fragments as they are received by said tank to promote the detachment of impurities and bark attached to or embedded in the incoming crushed wood fragements;

submerged flow nozzle means pivotally mounted in said washer tank for directing water generally upwardly said first outlet region for entraining the heavier crushed wood with the accept portion of the crusher output while permitting the sand and stone impurities and the heaviest crushed wood fragments to sink towards the second outlet region;

means attached to said submerged flow nozzle means for controlling the direction of flow of water from said flow nozzle means;

a sand separator positioned adjacent said second outlet region of said washer tank to receive the reject portion of the washed materials, comprising sand, stones, earth, bark and the heaviest crushed wood fragments, and to remove said sand, earth and stones from said bark and heaviest crushed wood fragments;

a coarse sieve positioned to receive said bark and heaviest crushed wood fragments of the reject portion from said sand separator for retaining the larger heaviest crushed wood fragments; and means for receiving said larger heaviest crushed wood fragments from said coarse sieve and for chipping the retained larger heaviest crushed wood fragments to reduce them to a size suitable for pulp production.

5. An apparatus according to claim 4 wherein submerged flow nozzle means comprises pressurized water nozzles positioned in the lower part of the washer tank and directed slantedly upwards towards said first outlet region of the tank.

6. An apparatus according to claim 4 and further comprising a roller crusher positioned to receive material of the reject portion which has passed through said coarse sieve for crushing the wood and bark material that has passed through said coarse sieve and particularly for pulverizing the bark material; and a fine sieve positioned after said roller crusher to retain the remaining wood material for the process and to pass the pulverized bark material to be discarded from the system.

7. An apparatus according to claim 4 wherein said means for removing said accept portion comprises a bladed wheel adjacent said first outlet region of said washer tank for scraping the washed crushed material fragments over an outlet end edge of said washer tank.

8. An apparatus according to claim 4 wherein said washing tank is funnel-shaped, said apparatus further comprising a slanted conveyor screw positioned at the bottom of said washer tank and having its lower end in the deepest part of the tank to remove sunken reject from the washer tank, and air-blowing nozzles within said tank and above said deepest part thereof for keeping in motion the reject tending to sink to the tank bottom and for preventing the lower end of the screw from being blocked.

9. An apparatus for continuous treatment of waste wood including stumps and snag to remove sand, stone, earth and other impurities and bark attached thereto and embedded therein to thereby render said waste wood suitable for production of pulp, the apparatus comprising crusher means for fragmenting said raw waste wood and partially loosening the attached and embedded impurities and bark therefrom;

a washer tank for washing the sand, earth and stone impurities and bark from said crushed wood fragments and for separating said materials into accept and reject portions;

said washer tank having a body of water therein and having an inlet region for receiving the output from said crusher means, a first outlet region near the surface of said body of water for discharging an accept portion of said crusher output, comprising crushed wood fragments and bark which tend to float near the surface of said body of water, and a second outlet region at the bottom of the water tank for discharging a reject portion of said crusher output, comprising sand, stone, earth, bark and heavier crushed wood fragments which tend to sink towards said second outlet region;

means adjacent said first outlet region for removing said accept portion form said tank;

nozzle means near the inlet region of said washer tank for directing jets of water under high pressure against the crushed wood fragments as they are received by said tank to promote the detachement of impurities and bark attached to or embedded in the incoming crushed wood fragments;

a submerged propeller mounted in said washer tank above said second outlet region for directing water generally upwardly toward said first outlet region for entraining the heavier crushed wood with the accept portion of the crusher output while permitting the sand and stone impurities and the heaviest crushed wood fragments to sink towards the second outlet region;

means for rotating said propeller;

means for controlling the speed and orientation of the axis of rotation of said propeller;

a sand separator positioned adjacent said second outlet region of said washer tank to receive the reject portion of the washed materials, comprising sand, stones, earth, bark and the heaviest crushed wood fragments, and to remove said sand, earth and stones from said bark and heaviest crushed wood fragments;

a coarse sieve positioned to receive said bark and heaviest crushed wood fragments of the reject portion from said sand separator for retaining the larger heaviest crushed wood fragments; and means for receiving said larger heaviest crushed wood fragments from said coarse sieve and for chipping the retained larger heaviest crushed wood fragments to reduce them to a size suitable for pulp production.

* * * * *